US009912051B2

(12) United States Patent
Sakai et al.

(10) Patent No.: US 9,912,051 B2
(45) Date of Patent: Mar. 6, 2018

(54) THREE-AXIS CONTROL ANTENNA DEVICE

(71) Applicant: MITSUBISHI ELECTRIC CORPORATION, Chiyoda-ku (JP)

(72) Inventors: Yuji Sakai, Chiyoda-ku (JP); Masanobu Horimoto, Chiyoda-ku (JP); Masakazu Saito, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 86 days.

(21) Appl. No.: 14/890,041

(22) PCT Filed: Feb. 27, 2014

(86) PCT No.: PCT/JP2014/054824

§ 371 (c)(1),
(2) Date: Nov. 9, 2015

(87) PCT Pub. No.: WO2014/188752

PCT Pub. Date: Nov. 27, 2014

(65) Prior Publication Data

US 2016/0126626 A1 May 5, 2016

(30) Foreign Application Priority Data

May 20, 2013 (JP) ..... 2013-105759

(51) Int. Cl.
*H01Q 3/08* (2006.01)
*H01Q 1/12* (2006.01)

(52) U.S. Cl.
CPC ..... *H01Q 3/08* (2013.01); *H01Q 1/125* (2013.01); *H01Q 1/1264* (2013.01)

(58) Field of Classification Search
CPC H01Q 1/125; H01Q 3/02; H01Q 3/08; H01Q 1/12; G01S 3/42; G01S 5/00; G01S 7/02; G01S 7/03
See application file for complete search history.

(56) References Cited

U.S. PATENT DOCUMENTS 4,994,815 A * 2/1991 Nakayama ..... G01S 3/42 343/765
5,149,350 A 9/1992 Itoh et al.
(Continued)

FOREIGN PATENT DOCUMENTS

CN 202142644 U 2/2012
CN 102394370 A 3/2012
(Continued)

OTHER PUBLICATIONS

Extended European Search Report dated Dec. 20, 2016 in Patent Application No. 14801858.3.
(Continued)

*Primary Examiner* — Bentsu Ro
*Assistant Examiner* — Said Bouziane
(74) *Attorney, Agent, or Firm* — Oblon, McClelland, Maier & Neustadt, L.L.P.

(57) ABSTRACT

A vertical axis driver drives a vertical axis for azimuth angle tracking. A horizontal axis driver drives a horizontal axis for elevation angle tracking. A cross horizontal axis driver drives a cross horizontal axis to which an antenna is attached, that is rotatable around an axis orthogonal to the horizontal axis. An arithmetic processing controller generates a drive signal of a constant azimuth angle the vertical axis when a maximum elevation angle of the antenna is greater than or equal to a set angle in a path of the target object in a single time of continuous tracking. When the maximum elevation angle of the antenna is less than the set angle in the path of the target object in the single time of continuous tracking, the controller issues a drive command of an azimuth angle direction to the vertical axis.

7 Claims, 7 Drawing Sheets

(56) References Cited

U.S. PATENT DOCUMENTS

| | | | | |
|---|---|---|---|---|
| 2002/0011958 | A1* | 1/2002 | Ogawa | H01Q 1/42<br>343/761 |
| 2012/0182194 | A1* | 7/2012 | Young | G01S 3/42<br>343/757 |

FOREIGN PATENT DOCUMENTS

| | | | | |
|---|---|---|---|---|
| CN | 202583331 | U | 12/2012 | |
| CN | 102983402 | A | 3/2013 | |
| EP | 0 246 635 | A2 | 11/1987 | |
| JP | 7-202541 | A | 8/1995 | |
| JP | 9-284033 | A | 10/1997 | |
| JP | 2009-022034 | A | 1/2009 | |
| JP | 2010-219601 | A | 9/2010 | |
| WO | WO 2012/028642 | A1 | 3/2012 | |
| WO | WO 2012028642 | A1 * | 3/2012 | H01Q 3/08 |

OTHER PUBLICATIONS

International Search Report dated May 20, 2014, in PCT/JP2014/054824 filed Feb. 27, 2014.

Combined Chinese Office Action and Search Report dated Mar. 2, 2017 in Patent Application No. 201480029368.9 (with partial English translation and English translation of categories of cited documents).

Chinese Office Action issued in Patent Application No. CN 201480029368.9 dated Nov. 24, 2017 (W/ English translation).

* cited by examiner

THREE-AXIS CONTROL ANTENNA DEVICE

TECHNICAL FIELD

The present disclosure relates to a three-axis control antenna device for tracking an orbiting satellite.

BACKGROUND ART

As an antenna device for tracking an orbiting satellite, for example, Patent Literature 1 discloses a three-axis control antenna device that drives and controls individually a vertical axis for azimuth angle tracking, a horizontal axis for elevation angle tracking, and a cross horizontal axis which is on the horizontal axis and orthogonal to the horizontal axis. The three-axis control antenna device in Patent Literature 1 performs switching so that when a beam direction of an antenna is less than or equal to a set elevation angle, inputs are given to drive inputs of two axes out of three axes, whereas when the beam direction of the antenna is greater than or equal to the set elevation angle, inputs are given to the drive inputs of all of the three axes. Also, after the switching to this three-axis driving, a value of a specific axis obtained by calculating the present values of the three axes is provided to the drive input of the specific axis out of the three axes. When tracking a satellite passing near the zenith, the three-axis control antenna device in Patent Literature 1 performs real-time tracking by commanding the vertical axis to drive in an azimuth angle direction and aligning the beam direction of the antenna with a target object for the horizontal axis and the cross horizontal axis.

Even though the rotation speed of the azimuth angle (for the vertical axis) of the three-axis control antenna device in Patent Literature 1 is limited to its own maximum speed, the tracking shortage is compensated by rotating the cross horizontal axis, thereby enabling continuous tracking of a satellite near the zenith.

CITATION LIST

Patent Literature

Patent Literature 1: Unexamined Japanese Patent Application Kokai Publication No. H7-202541

SUMMARY OF INVENTION

Technical Problem

The angle variation rate of the tracking beam (directivity) of the antenna increases especially when a satellite orbiting in a low orbit passes through the zenith. In such a circumstance, the rotation speed of the azimuth angle (for the vertical axis) is limited to its own maximum speed and this limitation is compensated by the rotation speed of the cross horizontal axis, however, when the satellite is in an even lower orbit, the compensation may be insufficient to continue tracking.

One possible strategy to deal with this problem is to increase the maximum angular speed of the azimuth angle (for vertical axis). However, by doing so, the motor size (rating) would need to be increased, thereby increasing largely the power necessary for driving, which would lead to increasing the capacity of the power source.

Given the above circumstances, it is an objective of the present disclosure to minimize the motor size or the power source capacity in a three-axis control antenna device for tracking an orbiting satellite.

Solution to Problem

To achieve the aforementioned objective, a three-axis control antenna device set forth in the present disclosure includes a vertical axis for azimuth angle tracking, supported by a base, the vertical axis rotatable in relation to the base around a vertical line; a horizontal axis for elevation angle tracking attached to the vertical axis and rotatable in relation to the vertical axis around a line orthogonal to the vertical axis in a half rotation; a cross horizontal axis attached to the horizontal axis, the cross horizontal axis rotatable in relation to the horizontal axis within an angle range smaller than the rotation angle of the horizontal axis, around an axis orthogonal to the horizontal axis; an antenna attached to the cross horizontal axis; a vertical axis servo controller, a horizontal axis servo controller, and a cross horizontal axis servo controller to drive and control the vertical axis, the horizontal axis and the cross horizontal axis, respectively; and an arithmetic processing controller to generate drive signals for the vertical axis servo controller, the horizontal axis servo controller, and the cross horizontal axis servo controller and provide the drive signals to perform tracking control in real time so that a beam direction of the antenna aligns with a direction of a target object. The arithmetic processing controller generates, when a maximum elevation angle of the antenna in a path of the target object is greater than or equal to a set elevation angle in a single time of continuous tracking, a drive signal for the vertical axis servo controller, the signal of a constant azimuth angle determined from the path of the target object. When the maximum elevation angle of the antenna in the path of the target object is less than the set elevation angle in the single time of continuous tracking, the arithmetic processing controller generates a drive signal for the vertical axis servo controller, the signal of an azimuth angle of the target object.

Advantageous Effects of Invention

The three-axis control antenna device according to the present disclosure can reduce the required maximum angular speed of the azimuth angle (vertical axis) required for tracking a low-orbiting satellite. This makes it possible to scale down the motor size and make the power source capacity smaller.

DESCRIPTION OF EMBODIMENTS

The Embodiments of the present disclosure are described hereinafter with reference to the drawings. The same reference signs denote the same or similar portions through the drawings.

Embodiment 1

Figure 1:
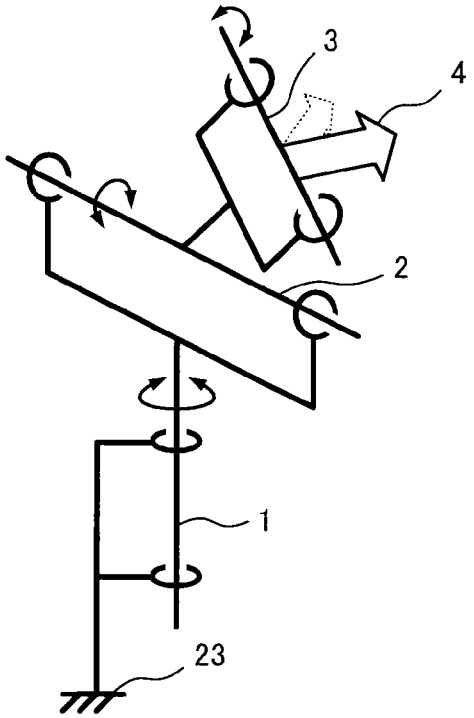
FIG. 1 is a conceptual diagram illustrating the mutual relationship between the mounts of a three-axis control antenna according to an embodiment of the present disclosure.

FIG. 1 is a conceptual diagram illustrating the mutual relationship between the mounts of a three-axis control antenna according to an embodiment of the present disclosure. The three-axis control antenna includes three axes, specifically a vertical axis 1, a horizontal axis 2, and a cross horizontal axis 3. The vertical axis 1 is supported by a base 23, and is rotatable in relation to the base 23 around a vertical line. The vertical axis 1 performs mainly the action of azimuth angle tracking of the antenna. The horizontal axis 2 is attached to the vertical axis 1, and is rotatable in a half rotation, approximately 180°, in relation to the vertical axis 1 around a line orthogonal to the vertical axis 1. The horizontal axis 2 performs elevation angle tracking.

The cross horizontal axis 3 is attached to the horizontal axis 2, and is rotatable in relation to the horizontal axis 2 within a certain angle range around an axis orthogonal to the horizontal axis 2. The rotatable angle range of the cross horizontal axis 3 is smaller than the rotation angle range of the horizontal axis 2. The antenna is fixed to the cross horizontal axis 3. The vertical axis 1, the horizontal axis 2 and the cross horizontal axis 3 enable a beam axis direction 4 of the antenna to be oriented in any intended direction.

Figure 2:
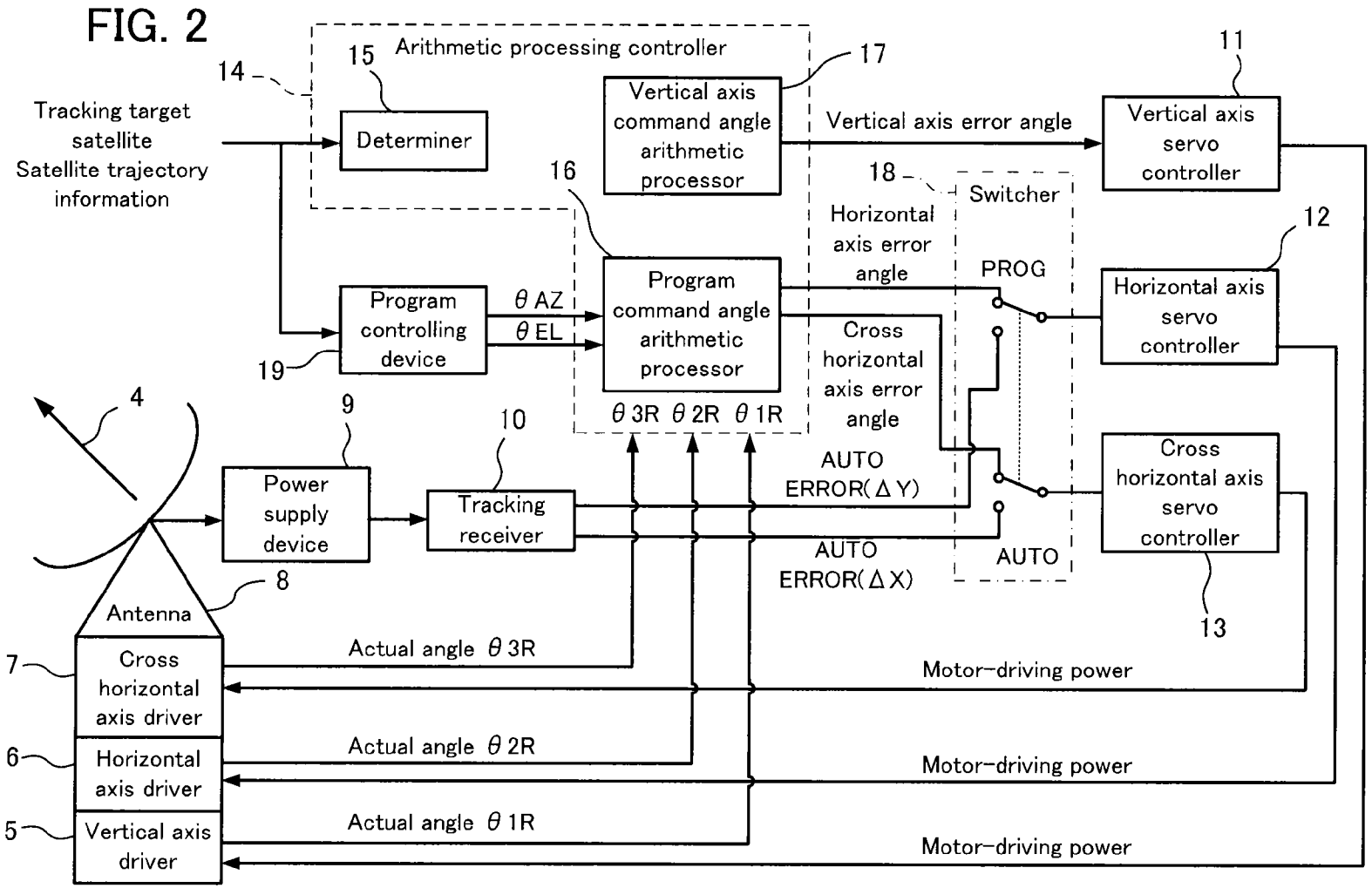
FIG. 2 is a block diagram illustrating a configuration example of a three-axis control antenna device according to Embodiment 1 of the present disclosure.

FIG. 2 is a block diagram illustrating a configuration example of a three-axis control antenna device according to Embodiment 1 of the present disclosure. A three-axis control antenna (hereinafter referred to as antenna) 8 includes mounts having a structure as illustrated in FIG. 1. A vertical axis driver 5 rotates the vertical axis 1 and a horizontal axis driver 6 rotates the horizontal axis 2. A cross horizontal axis driver 7 rotates the cross horizontal axis 3.

A power supply device 9 detects a reference signal and an error signal from the signal received by the antenna 8. A tracking receiver 10 demodulates and detects, from the reference signal and the error signal, direct current two-axis angle error signals (an angle error signal ΔX in the X-direction and an angle error signal ΔY in the Y-direction, of the antenna 8). A vertical axis servo controller 11 supplies motor-driving power to the vertical axis driver 5, and then drives and controls the vertical axis 1. A horizontal axis servo controller 12 supplies motor-driving power to the horizontal axis driver 6, and then drives and controls the horizontal axis. A cross horizontal axis servo controller 13 supplies motor-driving power to the cross horizontal axis driver 7, and then drives and controls the cross horizontal axis 3.

A program controlling device 19 calculates a program command angle of the azimuth angle (azimuth angle θAZ) and the elevation angle (elevation angle θEL) of the antenna 8 based on the trajectory information of the tracking target satellite.

An arithmetic processing controller 14 includes a determiner 15, a program command angle arithmetic processor 16, and a vertical axis command angle arithmetic processor 17. The determiner 15 determines among the three axes of the antenna 8 a combination of axes to be controlled for tracking based on trajectory information of the tracking target satellite. The program command angle arithmetic processor 16 and the vertical axis command angle arithmetic processor 17 receive the angle error signals ΔX and ΔY from the tracking receiver 10, and receive the program command angle from the program controller. The program command angle arithmetic processor 16 and the vertical axis command angle arithmetic processor 17 arithmetically process and output the angle command value of or the error amount of each axis according to the control mode (program tracking mode or automatic tracking mode) and the tracking state. The vertical axis command angle arithmetic processor 17 calculates the vertical axis command angle for driving the vertical axis of the three axes.

A switcher 18 switches the tracking signal according to the program tracking mode (PROG) or the automatic tracking mode (AUTO). The program tracking mode (PROG) is a mode in which an attitude of the antenna 8 is controlled according to the program command angle calculated by the program controlling device 19. The automatic tracking mode (AUTO) is a mode in which the attitude of the antenna 8 is controlled according to the angle error signals ΔX and ΔY demodulated and detected by the tracking receiver 10. The operation of the arithmetic processing controller 14 is described below.

In program tracking mode, the switcher 18 inputs respectively the horizontal axis error angle and the cross horizontal axis error angle arithmetically processed by the program command angle arithmetic processor 16 into the horizontal axis servo controller 12 and the cross horizontal axis servo controller 13. In automatic tracking mode, the switcher 18 inputs respectively the angle error signals ΔX and ΔY from the tracking receiver 10 into the horizontal axis servo controller 12 and the cross horizontal axis servo controller 13.

Figure 3:
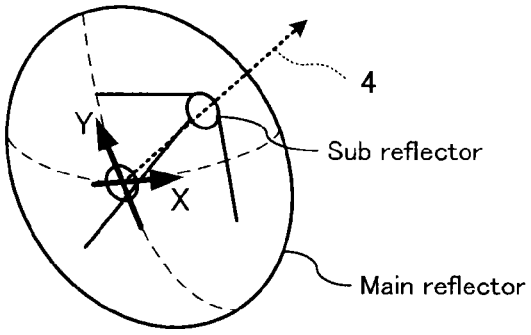
FIG. 3 is a diagram illustrating an X-Y coordinate system used for performing error detection of the three-axis control antenna device.

FIG. 3 is a diagram illustrating an X-Y coordinate system used for performing error detection of the three-axis control antenna device. The X-Y coordinate system is a coordinate system fixed to the mirror surface of the antenna 8. When the horizontal axis 2 is rotated, the beam axis direction 4 moves in the X-direction. The beam axis direction 4 can be oriented in the Y-direction by rotating the cross horizontal axis 3.

A determiner 15, based on the trajectory information of the tracking target satellite, obtains a maximum elevation angle of the tracking performed by the three-axis control antenna device, and then compares the maximum elevation angle with a predetermined set elevation angle. In a trajectory of a target satellite in a single time of continuous tracking, when the maximum elevation angle of the antenna 8 is greater than or equal to the set elevation angle, control is performed in two-axis control mode in which tracking is performed by the horizontal axis 2 and the cross horizontal axis 3. In a trajectory of a target satellite in a single time of continuous tracking, when the maximum elevation angle of the antenna 8 is less than the set elevation angle, control is performed in three-axis control mode in which tracking is performed by the vertical axis 1, the horizontal axis 2, and the cross horizontal axis 3.

Here, the set elevation angle is restricted to a drive range ($\Delta\theta 3max$) of the cross horizontal axis 3 and can be set using the following range.

$90° - \Delta\theta 3max < \text{set elevation angle} < 90°$

An elevation angle of 90° is the elevation angle at the zenith. The set elevation angle is set within a range that is greater than an angle obtained by subtracting the drive range ($\Delta\theta 3max$) of the cross horizontal axis 3 from the elevation angle at the zenith, and less than the elevation angle at the zenith.

The arithmetic processing controller 14 controls the beam axis direction 4 of the antenna 8 as follows when tracking is performed in automatic tracking mode and in two-axis control mode. A vertical axis command angle arithmetic processor 17 rotates the vertical axis 1 to an azimuth angle $\theta 1P$ so that the rotational direction of the horizontal axis 2 is parallel to the trajectory of the tracking target satellite based on trajectory information of the tracking target satellite.

The angle error signals $\Delta X$ and $\Delta Y$ demodulated and detected by the tracking receiver 10 are errors detected by the X-Y coordinate system fixed to the mirror surface as mentioned previously. The horizontal axis drive direction of the antenna 8 corresponds to the error detection direction $\Delta X$ in the X-direction, and the cross horizontal axis drive direction corresponds to the error detection direction $\Delta Y$ in the Y-direction. The angle error signal $\Delta X$ is supplied to the horizontal axis servo controller 12, and the angle error signal $\Delta Y$ is supplied to the cross horizontal axis servo controller 13. Then, tracking is performed by controlling the horizontal axis 2 and the cross horizontal axis 3 so as to eliminate errors.

Figure 4:
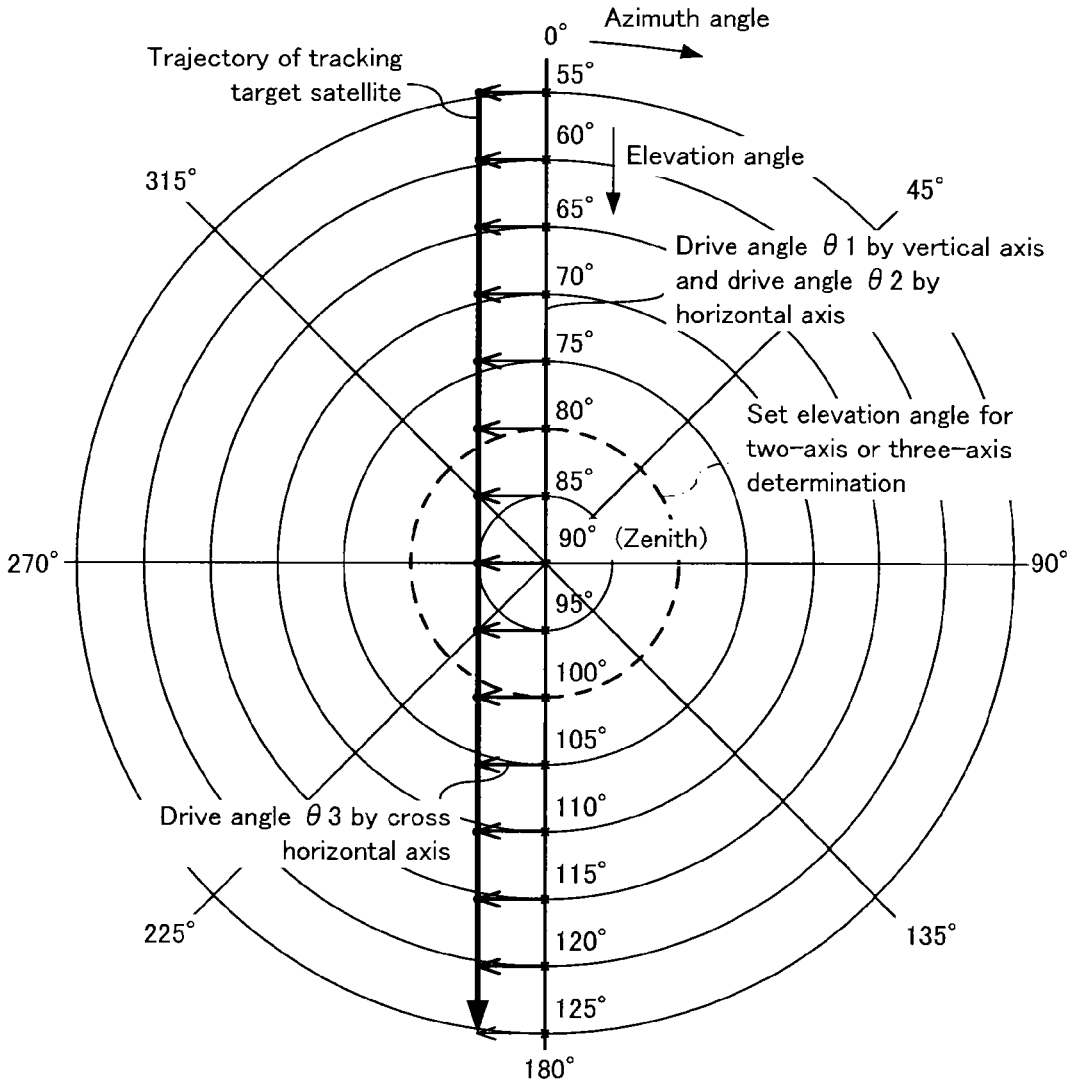
FIG. 4 is a plan view of each axis drive in two-axis control mode in Embodiment 1.

FIG. 4 is a plan view of each axis drive in two-axis control mode in Embodiment 1. FIG. 4 illustrates in a plan view the relationship between the direction of the trajectory of the target satellite and the direction of the drive angles as viewed from the zenith when tracking is performed in automatic tracking mode and in two-axis control mode. FIG. 4 illustrates a case in which the trajectory (path) of the tracking target satellite is parallel to the azimuth angle 0°. The maximum elevation angle (elevation closest to the zenith) of the antenna 8 in the trajectory of the tracking target satellite is greater than or equal to the set elevation angle used for determining the selection of two-axis control mode or three-axis control mode. In this case, since the vertical axis 1 is rotated so that the rotational direction of the horizontal axis 2 is parallel to the azimuth angle 0°, the elevation angle along the line of azimuth angle 0° is controlled mainly by the drive of the horizontal axis 2.

As can be seen from FIG. 4, since the trajectory of the tracking target satellite is parallel to the rotational direction (elevation angle change) of the horizontal axis 2, the satellite can be tracked without changing the vertical axis 1 during tracking by changing the X-direction with the horizontal axis 2 and changing the Y-direction with the cross horizontal axis 3. In this case, even when the elevation angle is near the zenith, there is no need to move (at least not significantly) the vertical axis 1 and the required maximum angular speed of the vertical axis 1 can be decreased. As a result, the motor size and the power source capacity can be kept to be small in a three-axis control antenna device for tracking an orbiting satellite.

Although FIG. 4 depicts a trajectory of a satellite in a straight line as seen from the zenith, there are many instances in which the actual trajectory is a slightly curved trajectory. Even in such cases, rotating in advance the vertical axis 1 to be oriented toward a constant azimuth angle so that the rotational direction of the horizontal axis 2 is nearly parallel to the trajectory (path) of the satellite eliminates the need to move the vertical axis 1 largely during tracking. As a method for calculating the direction (azimuth angle) of the vertical axis 1 which is parallel to the trajectory, a method for obtaining linear interpolation using the least-squares approach, a method for obtaining a satellite trajectory at maximum elevation (EL), or the like can be used. Also, the vertical axis 1, after being oriented to an azimuth angle to be nearly parallel to the trajectory, can be free and controlled continually in real time to remain parallel to the trajectory of a satellite.

When tracking in automatic tracking mode and in three-axis control mode, the arithmetic processing controller 14 in FIG. 2 controls the beam axis direction 4 of the antenna 8 as follows. The angle error signals $\Delta X$ and $\Delta Y$ demodulated and detected by the tracking receiver 10 are errors detected by the X-Y coordinate system fixed to the mirror surface as mentioned previously. In such a case, the horizontal axis drive direction of the antenna 8 corresponds to the error detection direction $\Delta Y$ and the cross horizontal axis drive direction corresponds to the error detection direction $\Delta X$. The angle error signal $\Delta Y$ is supplied to the horizontal axis servo controller 12, and the angle error signal $\Delta X$ is supplied to the cross horizontal axis servo controller 13. Also, the horizontal axis 2 and the cross horizontal axis 3 are controlled so as to eliminate errors. At the same time, an error between the azimuth angle of the beam axis direction 4 determined by the three axes of the antenna and the actual angle of the vertical axis 1 is supplied to the vertical axis servo controller 11 and tracking is performed by controlling the vertical axis so as to eliminate the error.

As a result of this, when the driving is performed in this three-axis control mode, the rotation of the vertical axis 1 is limited to its maximum speed by azimuth angle control, and the beam tracking shortage is compensated by tracking with the horizontal axis 2 and the cross horizontal axis 3 on the basis of the above-mentioned error signals.

Figure 5:
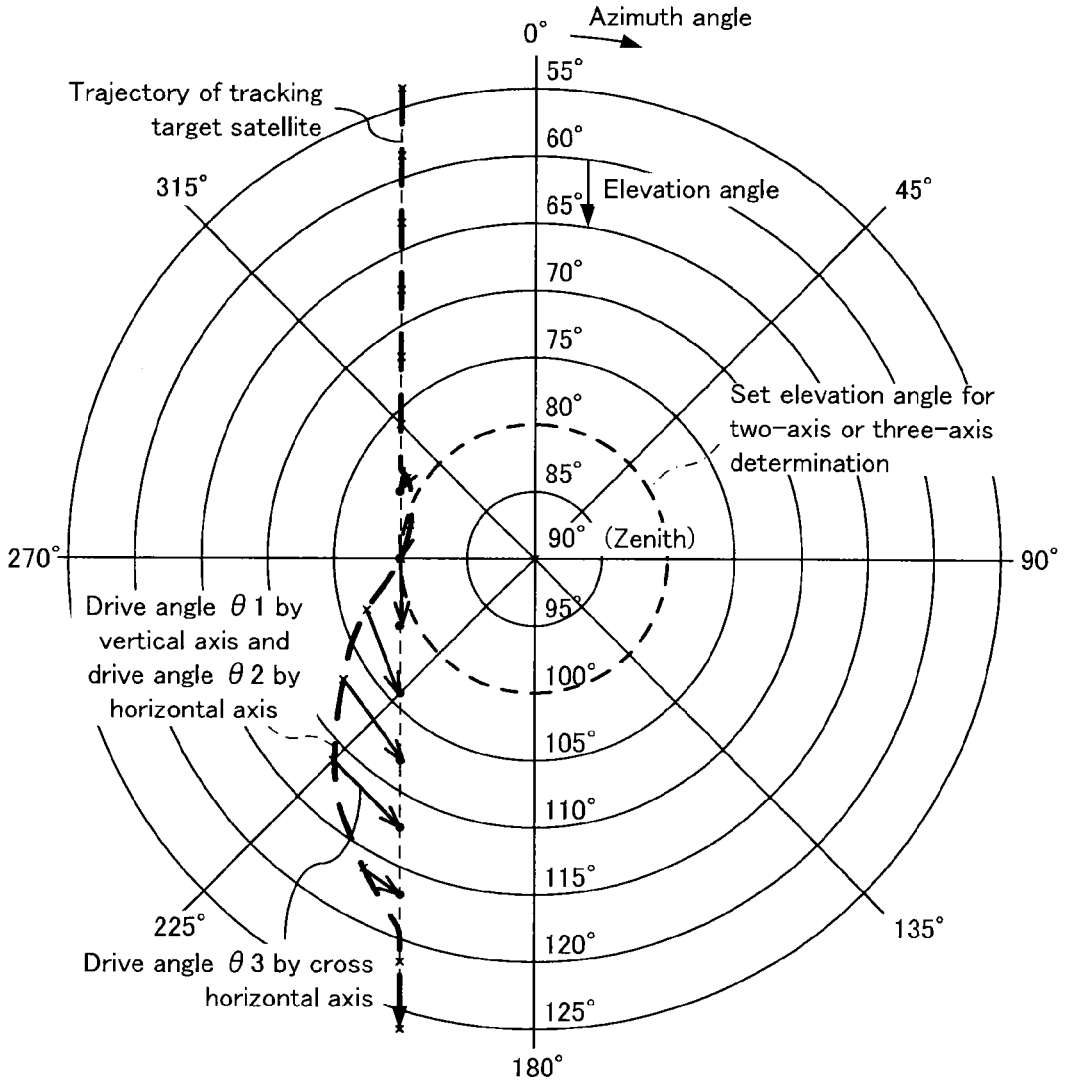
FIG. 5 is a plan view of each axis drive in three-axis control mode in Embodiment 1.

FIG. 5 is a plan view of each axis drive in three-axis control mode in Embodiment 1. FIG. 5 illustrates in a plan view the relationship between the direction of the trajectory of the target satellite and the direction of the drive angles as viewed from the zenith during tracking in automatic tracking mode and in three-axis control mode. The thin solid line represents the trajectory of the tracking target satellite and the broken line represents the drive angle by the vertical axis 1 and the horizontal axis 2. FIG. 5 illustrates a case in which the trajectory (path) of the tracking target satellite is parallel to the azimuth angle 0°. The maximum elevation angle (elevation angle closest to the zenith) of the antenna 8 in the trajectory of the tracking target satellite is less than the set elevation angle used for determining the selection of two-axis control mode or three-axis control mode.

As illustrated in FIG. 5, the maximum elevation angle of the antenna 8 in the trajectory of the tracking target satellite is less than the maximum elevation angle determination set value, and thus the angle variation rate of the tracking beam axis (directivity) is not very fast. Therefore, tracking can be performed sufficiently without increasing the drive speed of the vertical axis 1 to be able to perform tracking of the trajectory passing near the zenith.

Although FIG. 5 depicts a trajectory of a satellite in a straight line as seen from the zenith, there are many instances in which the actual trajectory is a slightly curved trajectory. Even in such cases, as long as the maximum elevation angle of the antenna 8 in the trajectory of the tracking target satellite is less than the maximum elevation angle determination set value, the angle variation rate of the tracking beam axis (directivity) does not get very fast. Therefore, tracking can be performed sufficiently without increasing the drive speed of the vertical axis 1 to be able to perform tracking of the trajectory passing near the zenith.

Hereafter, the operation is described for when tracking control is performed in program tracking mode and in two-axis control mode. The determiner 15 selects two-axis control mode when the maximum elevation angle of the antenna 8 in a trajectory of the target satellite in a single time of continuous tracking is greater than or equal to the set elevation angle. Even when tracking is performed in program tracking mode and in two-axis control mode, the vertical axis command angle arithmetic processor 17, based on trajectory information of the tracking target satellite, rotates in advance the vertical axis 1 so as to direct an azimuth angle θ1 P which is parallel to the trajectory. The arithmetic processing controller 14 receives program command angles (θAZ and θEL) from the program controlling device 19 and calculates the drive angles of the vertical axis 1, the horizontal axis 2 and the cross horizontal axis 3 in the program command angle arithmetic processor 16 inside the arithmetic processing controller 14 as the command angles for the respective axes. Also, the errors between the command angles and the actual angles θ1R, θ2R, and θ3R of the respective axes are each supplied to the vertical axis servo controller 11, the horizontal axis servo controller 12, and the cross horizontal axis servo controller 13, and then the drivers are controlled to direct the beam axis at intended angles.

At this point, the vertical axis command angle θ1C, horizontal axis command angle θ2C, and cross horizontal axis command angle θ3C are given by the following equations (1) through (3) using program command angles (θAZ, θEL) and vertical axis actual angle θ1R.

[Equation 1]

$$\theta 1C = \theta 1P \tag{1}$$

[Equation 2]

$$\theta 2C = \tan^{-1}\left\{\tan\theta EL \frac{1}{\cos(\theta 1R - \theta AZ)}\right\} \tag{2}$$

$$\theta 3C = \tan^{-1} \frac{\sin(\theta 1R - \theta AZ)}{\sqrt{\cos^2(\theta 1R - \theta AZ) + \tan^2\theta EL}} \tag{3}$$

Here, θ1R is the actual angle of the vertical axis 1.

Hereafter, operation is described for when tracking control is performed in program tracking mode and in three-axis control mode. The arithmetic processing controller 14 receives the program command angles (θAZ and θEL) from the program controlling device 19 and calculates the drive angles of the vertical axis 1, the horizontal axis 2, and the cross horizontal axis 3 in the program command angle arithmetic processor 16 inside the arithmetic processing controller 14 as the command angles for respective axes. Also, the errors between the command angles and the actual angles θ1R, θ2R, and θ3R of the respective axes are each supplied to the axis servo controllers 11, 12, and 13, and then the drivers are controlled to direct the beam axis at the intended angles.

At this point, the vertical axis command angle θ1C, the horizontal axis command angle θ2C, and the cross horizontal axis command angle θ3C are given by the following equations (4) through (6) using the program command angles (θAZ and θEL), the vertical axis actual angle θ1R, and the horizontal axis actual angle θ2R.

[Equation 3]

$$\theta 1C = \theta AZ \tag{4}$$

[Equation 4]

$$\theta 2C = \tan^{-1}\left\{\tan\theta EL \frac{1}{\cos(\theta 1R - \theta AZ)}\right\} \tag{5}$$

$$\theta 3C = \tan^{-1} \frac{\sin(\theta 1R - \theta AZ)}{\sqrt{\cos^2(\theta 1R - \theta AZ) + \tan^2\theta EL}} \tag{6}$$

Here θ1R is the actual angle of the vertical axis 1 and θ2R is the actual angle of the horizontal axis 2.

Even while in program tracking mode, when the maximum elevation angle of the antenna 8 is greater than or equal to the set elevation angle in a trajectory of the target satellite in a single time of continuous tracking, the two-axis control mode is selected and the vertical axis 1 is rotated so as to direct an azimuth angle θ1P that is parallel to the trajectory. Therefore, the required maximum angular speed of the vertical axis 1 can be decreased. As a result, the motor size and the power source capacity can be kept to be small in a three-axis control antenna device for tracking an orbiting satellite.

As described above, the controls performed in two-axis control mode and in three-axis control mode are the same regardless of being in the automatic tracking mode or in the program tracking mode, except for the way of supplying the errors signals to the vertical axis servo controller 11. The controls performed on the horizontal axis servo controller 12 and the cross horizontal axis servo controller 13 are exactly the same. Thus, a computational algorithm can be realized easily.

In three-axis control mode, control can be performed as follows. The program command angle (θAZ) is received from the program controlling device 19, the drive angle of the vertical axis 1 is calculated as the command angle of each axis in the program command angle arithmetic processor 16 inside the arithmetic controller 14 and the error between the command angle and the actual angle of the vertical axis 1 is supplied to the vertical axis servo controller 11. Also, the angle error signal ΔY demodulated and detected by the tracking receiver 10 is supplied to the horizontal axis servo controller 12, and the angle error signal ΔX is supplied to the cross horizontal axis servo controller 13. The horizontal axis servo controller 12 and the cross horizontal axis servo controller 13 control respectively the horizontal axis 2 and the cross horizontal axis 3 so as to eliminate errors. Tracking can also be performed by controlling so as to eliminate errors as described above.

Embodiment 2

In Embodiment 2, when control is performed while in the above-described two-axis control mode, after the vertical axis 1 is rotated to an azimuth angle θ1P so that the rotational direction of the horizontal axis 2 is parallel to the trajectory of the tracking target satellite, the vertical axis 1 is maintained at that angle in relation to the base 23 by a movement stopper such as a brake.

Figure 6:
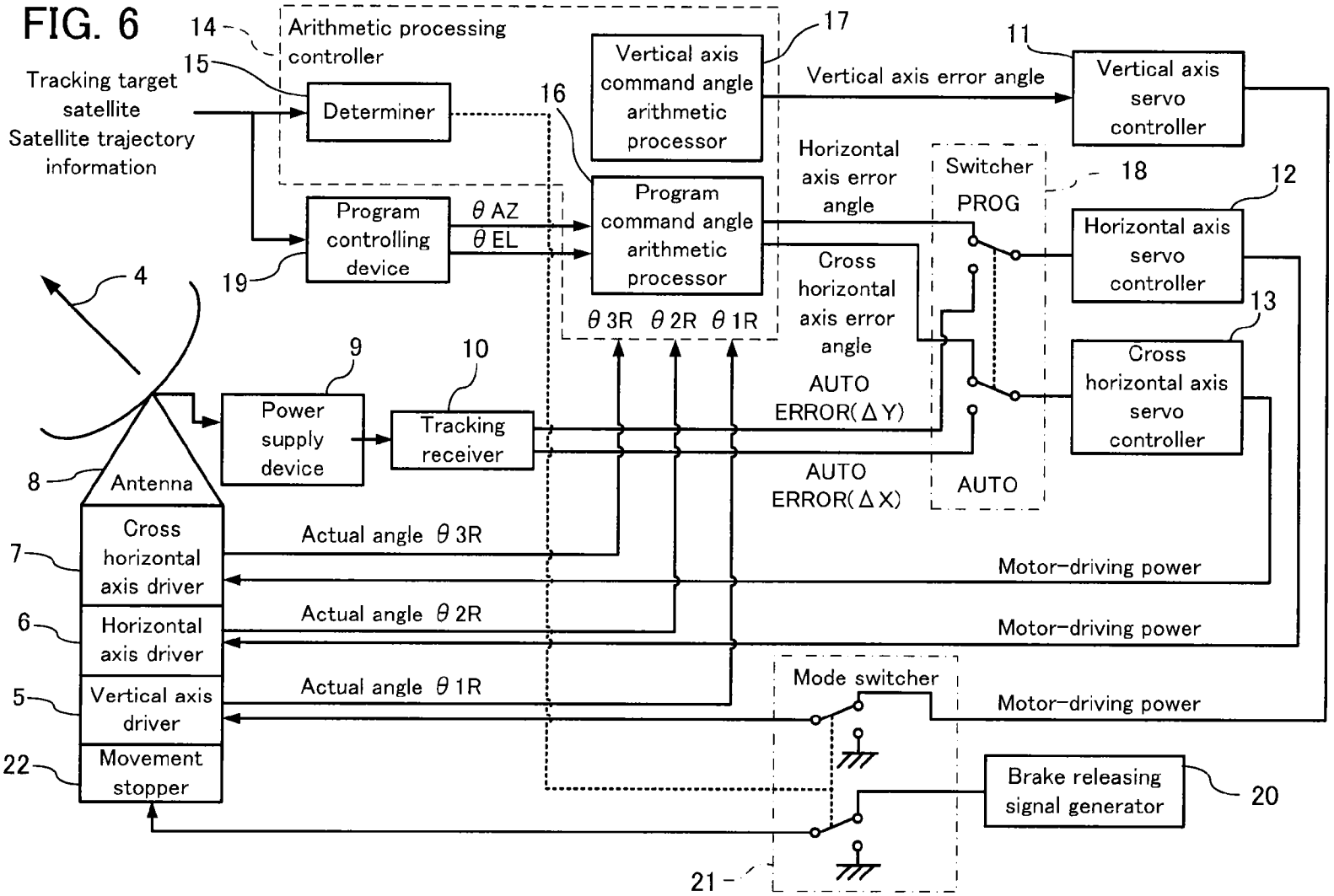
FIG. 6 is a block diagram illustrating an example configuration of a three-axis control antenna device according to Embodiment 2 of the present disclosure.

FIG. 6 is a block diagram illustrating an example configuration of a three-axis control antenna device according to Embodiment 2 of the present disclosure. The three-axis control antenna device of Embodiment 2, in addition to the configuration in Embodiment 1, includes a brake releasing signal generator 20, a mode switcher 21, and a movement stopper 22.

Embodiment 1 describes a case in which the vertical axis 1 is fixed by providing zero as an error signal to the vertical axis servo controller 11 under control in two-axis control mode. In two-axis control mode, since the tracking with the beam of the antenna 8 is performed by controlling the horizontal axis 2 and the cross horizontal axis 3, the supply of motor-driving power to the vertical axis servo controller 11 can be stopped after the vertical axis 1 is directed in the intended direction, and the angle can be maintained with respect to the base 23 by a brake or the like.

When the determiner 15 determines performing control in two-axis control mode, the vertical axis 1 is rotated to an azimuth angle θ1P so that the rotational direction of the horizontal axis 2 is parallel to the trajectory of the tracking target satellite, and then the mode switcher 21 switches to block sending of a brake releasing signal to the movement stopper 22 thereby causing a brake to be applied to the vertical axis 1 so as to maintain the angle with respect to the base 23. Also, at the same time, motor-driving power to the vertical axis 1 is cut off.

When the determiner 15 determines performing control in three-axis control mode, the mode switcher 21 switches to the side of the brake releasing signal generator 20, a brake releasing signal is sent to the movement stopper 22 thereby causing the brake applied to the vertical axis 1 to be released. At the same time, the motor-driving power is supplied to the vertical axis 1. The tracking mode in two-axis control mode can be either automatic tracking mode or program tracking mode. The operation of the horizontal axis 2 and the cross horizontal axis 3 is the same as in Embodiment 1. Also, the operation of the three-axis control mode is the same as in Embodiment 1.

In two-axis control mode, since the vertical axis 1 is rotated to an azimuth angle θ1P so that the rotational direction of the horizontal axis 2 is parallel to the trajectory of the tracking target satellite, tracking can be performed just by operating the horizontal axis 2 and the cross horizontal axis 3 without moving the vertical axis 1 during tracking operation. According to Embodiment 2, since the motor-driving power for the vertical axis 1 is unnecessary in two-axis control mode, power consumption can be reduced accordingly.

The calculation result of the required drive speed for each axis when the satellite altitude is 400 km is described below. Here, calculations were made based on an example in which the angular speed of the horizontal axis 2 is 2°/second (s), the angular speed of the cross horizontal axis 3 is 1.5°/second (s), and the drivable range of the cross horizontal axis 3 is ±10°. Also, it is assumed that each servo controller is a commonly-used type.

Comparative Example

Figure 7A:
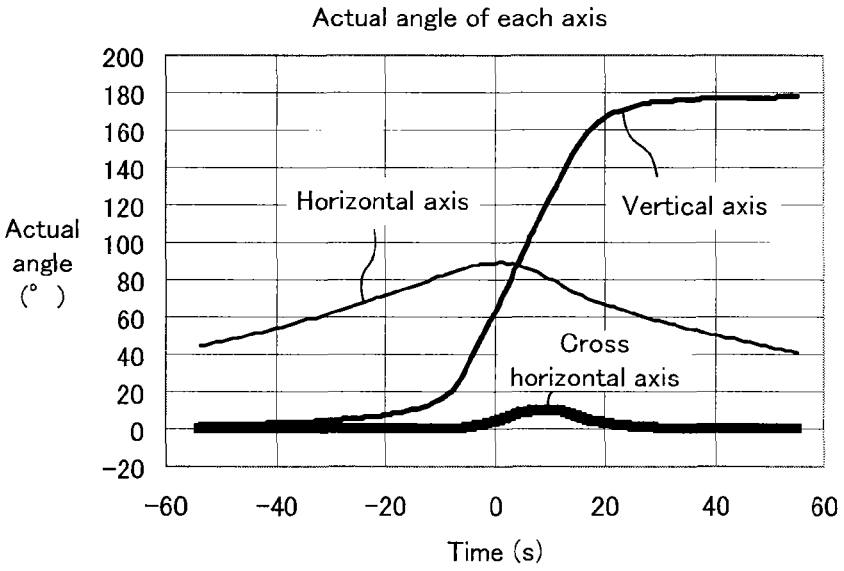
FIG. 7A is a diagram illustrating a calculation result of a drive angle of each axis for satellite tracking in a comparative example.
Figure 7B:
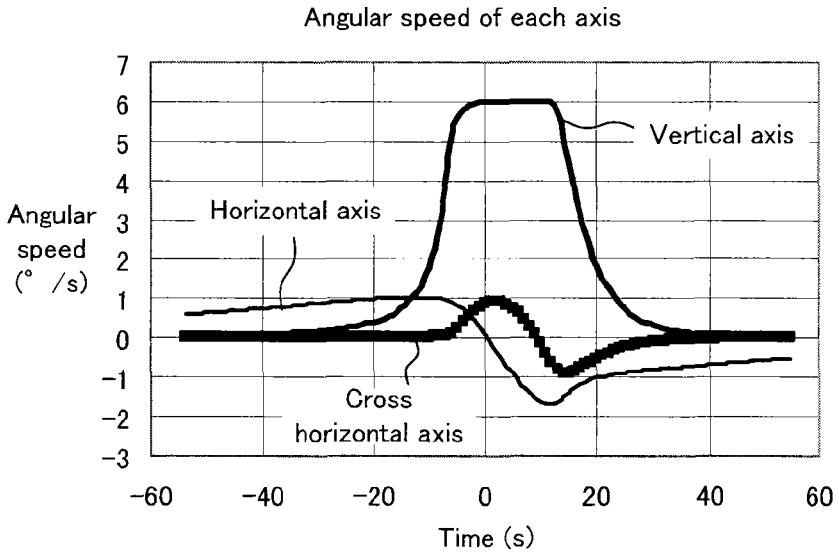
FIG. 7B is a diagram illustrating a calculation result of a drive angular speed of each axis for satellite tracking in a comparative example.

FIG. 7A is a diagram illustrating a calculation result of a drive angle of each axis for satellite tracking in a comparative example. FIG. 7B is a diagram illustrating a calculation result of a drive angular speed of each axis for satellite tracking in a comparative example. The comparative example is a calculation result of a typical three-axis drive control when the maximum elevation angle is approximately 87.5°.

As can be seen in FIG. 7A, the rate of change (slope) in the actual angle of the vertical axis 1 is large near the zenith (the actual angle=approximately 90°) and as can be seen in FIG. 7B, the maximum angular speed of the vertical axis 1 is approximately 6°/s.

Specific Example

Figure 8A:
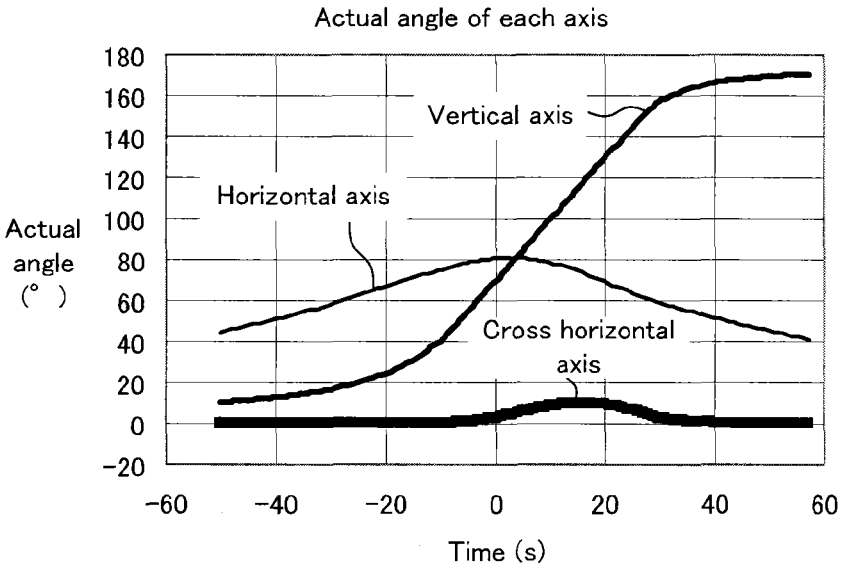
FIG. 8A is diagram illustrating a calculation result of a drive angle of each axis for satellite tracking in a specific example of Embodiment 1.
Figure 8B:
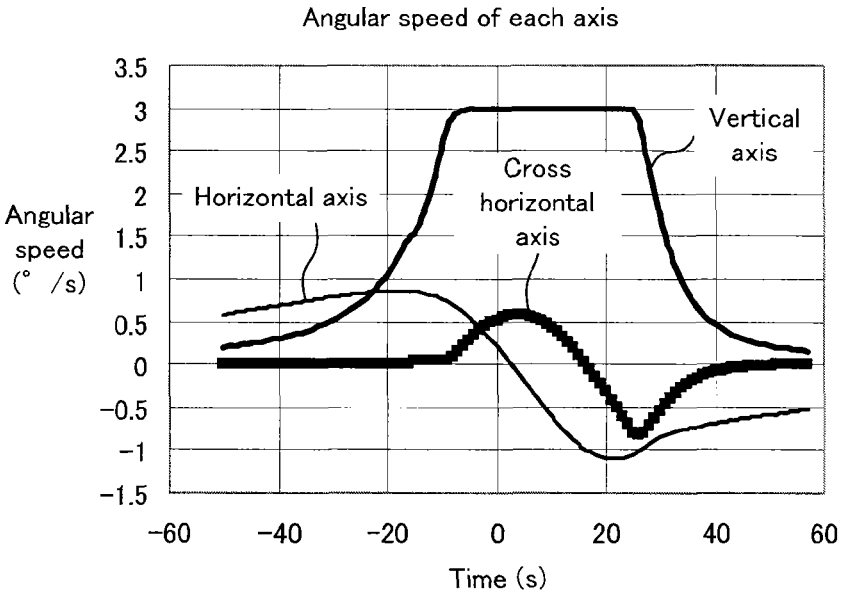
FIG. 8B is a diagram illustrating a calculation result of a drive angular speed of each axis for satellite tracking in the specific example.

FIG. 8A is diagram illustrating a calculation result of a drive angle of each axis for satellite tracking in a specific example of Embodiment 1. FIG. 8B is a diagram illustrating a calculation result of a drive angular speed of each axis for satellite tracking in a specific example. The specific example is a calculation result when the maximum elevation angle is approximately 80° while in three-axis control mode in Embodiment 1. In this example, since two-axis control mode is engaged when the maximum elevation angle exceeds 80°, the angular speed of the vertical axis 1 is at maximum when the maximum elevation is approximately 80° while in three-axis control mode.

As can be seen in FIG. 8A, when the maximum elevation angle is 80° even in three-axis control mode, the rate of change (slope) in the actual angle of the vertical axis 1 is smaller in comparison to FIG. 7A. As can be seen in FIG. 8B, the maximum angular speed of the vertical axis 1 is approximately 3°/s. When the maximum elevation angle exceeds 80°, two-axis control mode is engaged and thus approximately 3°/s is regarded as the maximum angular speed of the vertical axis 1. Therefore, according to the present embodiment, it is evident that the maximum angular speed of the vertical axis 1 can be significantly reduced in comparison with the comparative example.

The present disclosure can be embodied in various ways and can undergo various modifications without departing from the broad spirit and scope of the disclosure. Moreover, the embodiment described above is for explaining the present disclosure, and does not limit the scope of the present disclosure. In other words, the scope of the present disclosure is as set forth in the Claims and not the embodiment. Various changes and modifications that are within the scope disclosed in the claims or that are within a scope that is equivalent to the claims of the disclosure are also included within the scope of the present disclosure.

This application claims the benefit of Japanese Patent Application No. 2013-105759, filed on May 20, 2013, including the specification, claims, drawings and abstract. The entire disclosure of the Japanese Patent Application No. 2013-105759 is incorporated herein by reference.

REFERENCE SIGNS LIST

1 Vertical axis
2 Horizontal axis
3 Cross horizontal axis
4 Beam axis direction
5 Vertical axis driver
6 Horizontal axis driver
7 Cross horizontal axis driver
8 Three-axis control antenna
9 Power supply device
10 Tracking receiver
11 Vertical axis servo controller

12 Horizontal axis servo controller
13 Cross horizontal axis servo controller
14 Arithmetic processing controller
15 Determiner
16 Program command angle arithmetic processor
17 Vertical axis command angle arithmetic processor
18 Switcher
19 Program controlling device
20 Brake releasing signal generator
21 Mode switcher
22 Movement stopper
23 Base

The invention claimed is:

1. A three-axis control antenna device, comprising:

a vertical axis for azimuth angle tracking, supported by a base and rotatable in relation to the base around a vertical line;

a horizontal axis for elevation angle tracking, attached to the vertical axis and rotatable in relation to the vertical axis around a line orthogonal to the vertical axis in a half rotation;

a cross horizontal axis attached to the horizontal axis and rotatable in relation to the horizontal axis, within an angle range smaller than the rotation angle of the horizontal axis, around an axis orthogonal to the horizontal axis;

an antenna attached to the cross horizontal axis;

a vertical axis servo controller, a horizontal axis servo controller, and a cross horizontal axis servo controller to drive and control the vertical axis, the horizontal axis, and the cross horizontal axis, respectively; and an arithmetic processing controller to generate drive signals for the vertical axis servo controller, the horizontal axis servo controller, and the cross horizontal axis servo controller, and provide the drive signals to perform tracking control in real time so that a beam direction of the antenna aligns with a direction of a target object, wherein the arithmetic processing controller generates, when a maximum elevation angle of the antenna in a path of the target object is greater than or equal to a set elevation angle in a single time of continuous tracking, a drive signal for the vertical axis servo controller, the drive signal of a constant azimuth angle determined from the path of the target object, and when the maximum elevation angle of the antenna in the path of the target object is less than the set elevation angle in the single time of continuous tracking, the arithmetic processing controller generates a drive signal for the vertical axis servo controller, the drive signal of an azimuth angle of the target object, the azimuth angle determined from the path of the target object is the azimuth angle to which the vertical axis is rotated such that a rotational direction of the horizontal axis is parallel to the path of the target object.

2. The three-axis control antenna device according to claim 1, wherein the set elevation angle is a predetermined angle within a range that is greater than an angle obtained by subtracting the angle range of the cross horizontal axis from the elevation angle at the zenith, and less than the elevation angle at the zenith.

3. The three-axis control antenna device according to claim 1, wherein the arithmetic processing controller generates, when the maximum elevation angle of the antenna in the path of the target is greater than or equal to the set elevation angle in the single time of continuous tracking, the drive signal of the constant azimuth angle continuously for the vertical axis servo controller while tracking, the azimuth angle determined from the path of the target object.

4. The three-axis control antenna device according to claim 1, further comprising:

a movement stopper to maintain the vertical axis in an intended rotational position, wherein when the maximum elevation angle of the antenna in the path of the target object is greater than or equal to the set elevation angle in the single time of continuous tracking, upon the arithmetic processing controller commanding a drive signal of the constant azimuth angle determined from the path of the target object for the vertical axis servo controller, the movement stopper maintains the vertical axis in the intended position.

5. The three-axis control antenna device according to claim 1, further comprising:

a tracking receiver to obtain an angle error signal from a signal received by the antenna, wherein the horizontal axis servo controller and the cross horizontal axis servo controller each perform tracking control based on the corresponding angle error signal.

6. The three-axis control antenna device according to claim 1, further comprising:

a program controller to calculate, from an estimated trajectory of the target object, a program azimuth angle and a program elevation angle that orient the beam direction of the antenna at a position in a control time of the estimated trajectory, wherein the arithmetic processing controller generates, when the maximum elevation angle of the antenna in the path of the target object is greater than or equal to the set elevation angle in the single time of continuous tracking, a drive signal of a constant azimuth angle determined from the path of the target object for the vertical axis servo controller and a drive signal for real-time control at the angle obtained by calculation using the program azimuth angle and the program elevation angle, and when the maximum elevation angle of the antenna in the path of the target object is less than the set elevation angle in the single time of continuous tracking, the arithmetic processing controller generates the drive signal of the program azimuth angle for the vertical axis servo controller and generate the drive signals that control in real-time at the angles obtained by calculation using the actual angle of the vertical axis, the program azimuth angle, and the program elevation angle for the horizontal axis servo controller and the cross horizontal axis servo controller.

7. The three-axis control antenna device according to claim 1, further comprising:

a program controller to calculate, from an estimated trajectory of the target object, a program azimuth angle and a program elevation angle to orient the beam direction of the antenna at a position in a control time of the estimated trajectory; and a tracking receiver to obtain an angle error signal from a signal received by the antenna, wherein the arithmetic processing controller generates, when the maximum elevation angle of the antenna in the path of the target object is greater than or equal to the set elevation angle in the single time of continuous tracking, a drive signal of a constant azimuth angle determined from the path of the target object for the vertical axis servo controller and a drive signal for real-time control at the angle obtained by calculation using the program azimuth angle and the program elevation angle, and when the maximum elevation angle of the antenna in the path of the target object is less than the set elevation angle in the single time of continuous tracking, the arithmetic processing controller generates the drive signal of the program azimuth angle for the vertical axis servo controller and performs tracking control based on the angle error signal corresponding to each of the horizontal axis servo controller and the cross horizontal axis servo controller.

* * * * *